United States Patent [19]

Leonovich, Jr.

[11] Patent Number: 4,939,912

[45] Date of Patent: Jul. 10, 1990

[54] COMBINATION PORTABLE COOLER WITH AUDIO RECEIVER AND PORTABLE COOLER WITH AUDIO SYSTEM

[76] Inventor: George A. Leonovich, Jr., 270 Communications Way, Hyannis, Mass. 02601

[21] Appl. No.: 427,196

[22] Filed: Oct. 26, 1989

[51] Int. Cl.[5] ..... F25D 3/08

[52] U.S. Cl. ..... 62/457.1; 62/457.7; 312/7.1; 312/237; 381/90; 455/344; 455/351

[58] Field of Search ..... 62/457.1, 457.2, 457.7; 455/344, 351; 312/7.1, 237, 246; 381/90, 159

[56] References Cited

U.S. PATENT DOCUMENTS

| | | | |
|---|---|---|---|
| 3,406,532 | 10/1968 | Round et al. | 62/457.2 |
| 4,279,342 | 7/1981 | Van Pelt | 62/457.1 X |
| 4,571,740 | 2/1986 | Kirby et al. | 62/457.7 X |
| 4,700,395 | 10/1987 | Long | 62/457.7 X |

*Primary Examiner*—Lloyd L. King
*Attorney, Agent, or Firm*—Thomas A. Kahrl

[57] ABSTRACT

The present invention provides a portable food and beverage cooler with an integral audio receiver, preferably and AM/FM radio receiver. The cooler has an outer shell, an intermediate insulation layer, an inner shell, a partially removable top with handle for carrying cooler, and an inner compartment enclosed by four adjoining walls for holding food and beverages. The audio receiver includes a plurality of components including the receiver unit, one or more speakers, a power source battery, receptacle for earphones, jack separately mounted in compartments provided in one or more of the walls, with components in the wiring means connecting the audio insulation layer. Protective screens and waterproof sealing means are provided for keeping sand and moisture out of the speakers to improve quality of sound. Insulation of cooler also insulate components from sand, heat and moisture.

9 Claims, 3 Drawing Sheets

COMBINATION PORTABLE COOLER WITH AUDIO RECEIVER AND PORTABLE COOLER WITH AUDIO SYSTEM

BACKGROUND OF THE INVENTION

The present invention relates to providing a light-weight portable cooler for food and beverages including a portable audio receiver, and to providing a portable cooler with audio receiver system.

Carrying food and beverage containers and other articles such as a portable AM/FM radio or tape cassette recorder by hand to the location of a picnic or a beach or other outdoor activity, often remote from access by vehicle, is frequently cumbersome and tiring. Portable coolers are generally available which are light-weight and convenient and portable AM/FM radios or tape cassette recorders are available which are compact and light-weight. Nevertheless, it is difficult to carry such audio receiver units in addition to other picnic articles, particularly to the beach, and in addition small portable AM/FM radios or tape cassette or compact disc players are susceptible to malfunction due to the action of sand and moisture, especially salt water.

It is therefore and object of this invention to provide a light-weight portable cooler which incorporates an audio system including a receiver and one or more speakers adapted to operate on a portable power source.

It is a further object of this invention to provide a light-weight portable cooler which incorporates an AM/FM radio including a portable power source, receiver and one or more speakers.

Another object of the present invention is to provide light-weight audio components installed in a light-weight cooler by means which protect the components from sand and moisture.

A further object of the present invention is to provide a portable cooler with a radio having multiple spaced speakers for improved audio quality of sound which are protected from moisture and contamination from sand.

SUMMARY OF THE INVENTION

The present invention is directed to an improved portable cooler and audio receiver and to an audio system employing the improved portable cooler.

The present invention comprises a portable light-weight cooler including, an insulated container with four adjoining walls, a first wall characterized by a plurality of cut-outs adapted to receive, in the preferred embodiment, components of a portable AM/FM radio circuit sealably positioned in spaced relationships in the first wall of the container. The cooler is of conventional construction, and can be of variable size, though in the preferred embodiment said cooler is of a size sufficient to hold up to six beverage containers as well as a conventional coolant packet.

The cooler includes a main compartment of generally rectangular shape enclosed by four walls, integrally connected to a base to provide a space for items, a partially removable hinged top with handle, having hinge means and a latch means for providing access to the cooler's main compartment. The container handle, for use in carrying the cooler, is formed integrally with the top and is provided with socket means for mounting a conventional retractable antenna.

The container has a resilient outer shell formed from a sheet of plastic material, a resilient inner shell, formed in a sheet of plastic, an intermediate void filled with liquid filled foam insulation disposed between the outer and inner shell.

In the preferred embodiment, the first wall includes a plurality of cut-outs including a receiver cut-out and a plurality of speaker cut-outs and a power source compartment. An AM/FM radio receiver is mounted in the receiver cut-out and is connected by electrical wire means to a plurality of speakers preferably two, mounted in the speaker cut-outs being disposed on opposite sides of the receiver in the front wall each being connected by wiring means to a power source, preferably a 9 volt dc battery. The antenna is retractably mounted on a socket and is adapted to be received in a groove in the top of the handle disposed in parallel relationship with the top of the handle when not in use. A battery compartment is provided in the first wall of the container to include a 9 volt battery for attachment with battery clip means connected by wiring to the receiver.

The cooler is of molded construction, with an intermediate layer of foam insulation material wherein the outer shell includes openings for mounting audio components including a radio receiver, speakers, battery and earphone jack, by screw means. During construction of the cooler the inner shell is attached to the outer shell having the radio receiver and speakers affixed thereto, and the battery compartment extending inwardly in the intermediate void and each interconnected by insulated electrical wiring means Foam insulating material while in a liquid state is pumped into the void through an opening in the base of the compartment sealing the receiver and speakers. The speakers are protected from sand and other contaminants, including water, by disc shaped screens having a fine wire mesh mounted on the front of the speakers. Both the speaker and the radio receiver are protected by washer and gasket means provided on the mounting surfaces of the respective compartments.

Another embodiment of the invention includes a tape cassette in lieu of the radio receiver. In yet another embodiment a solar power unit is incorporated in lieu of a 9 volt battery.

The invention will be described for purposes of illustration only in connection with certain embodiments; however, it is recognized that those persons skilled in the art may make various changes, modifications, improvements and additions on the illustrated embodiments, all without departing from the spirit and scope of the invention.

DESCRIPTION OF THE EMBODIMENTS

Figure 1:
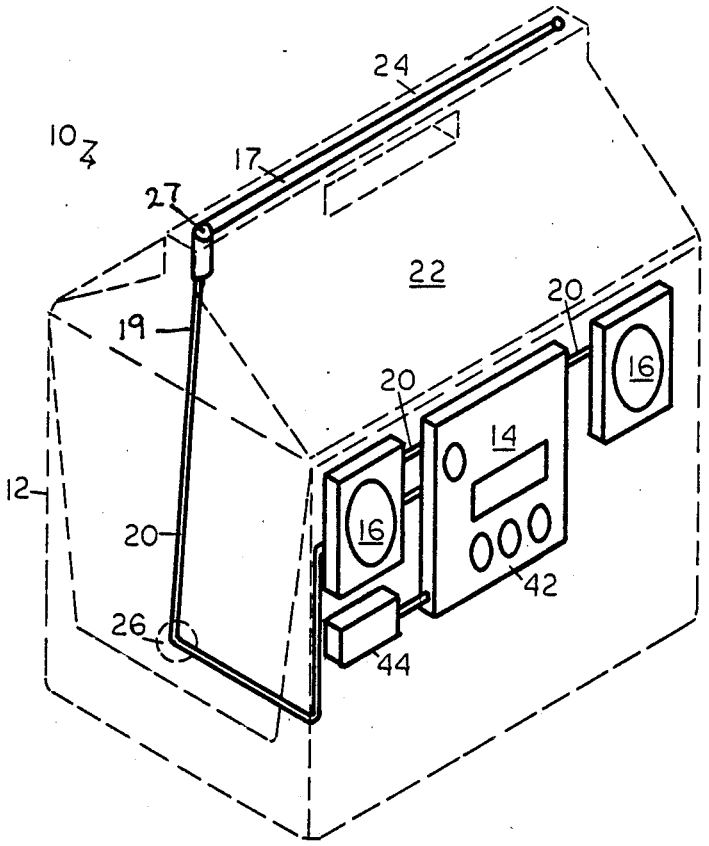
FIG. 1 is a perspective view of a preferred embodiment combination cooler and audio system of the invention showing the employment of the improved cooler;.
Figure 2:
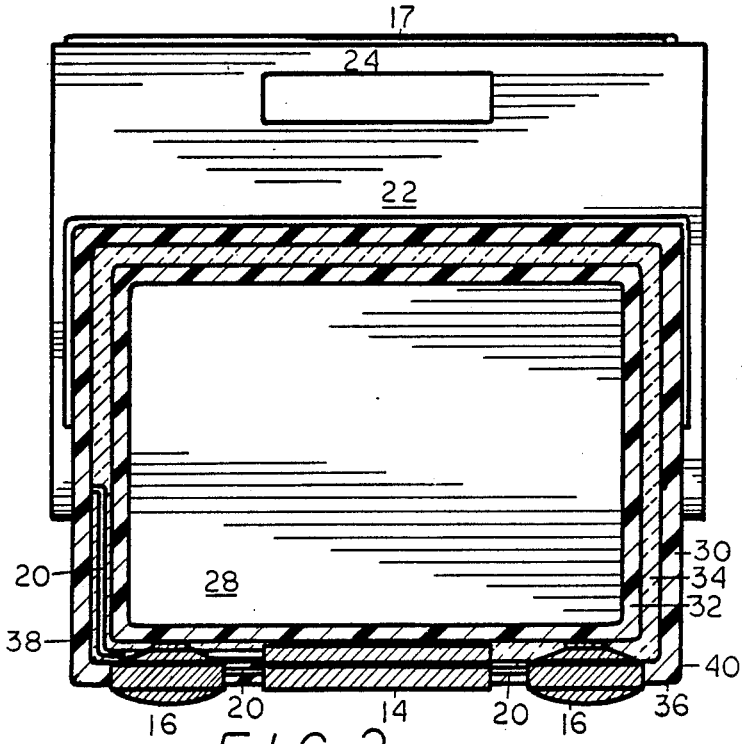
FIG. 2 is a top elevational, partially sectional view of the improved cooler of the invention as employed in FIG. 1.

With reference to the drawings, FIG. 1 shows a preferred embodiment of a combination portable cooler with radio system 10, including a cooler 12 and a radio circuit 13 mounted integrally on the cooler 12. The radio circuit 13 comprises a conventional radio receiver 14 a plurality of conventional speakers 16, consisting of a first and second speaker, a power source 18, consisting of a 9 volt dc battery in the preferred embodiment, a retractable antenna 17 with antenna cable 19 and wire means 20 for electrically connecting the power source 18 to the receiver 14 and to the speakers 16. With reference to FIGS. 1 and 2, the cooler 12 includes a partially removable top 22 with integral handle 24, and a hinge means 26 connecting the top 22 to an insulated container 28 in a manner permitting the top 22 to be rotably moved through of an arc of approximately 90 degrees, either to the front or to the rear of the container 28 from a closed position to an open position, and a socket 27 adapted to receive one end of the antenna 17 for mounting.

Figure 3:
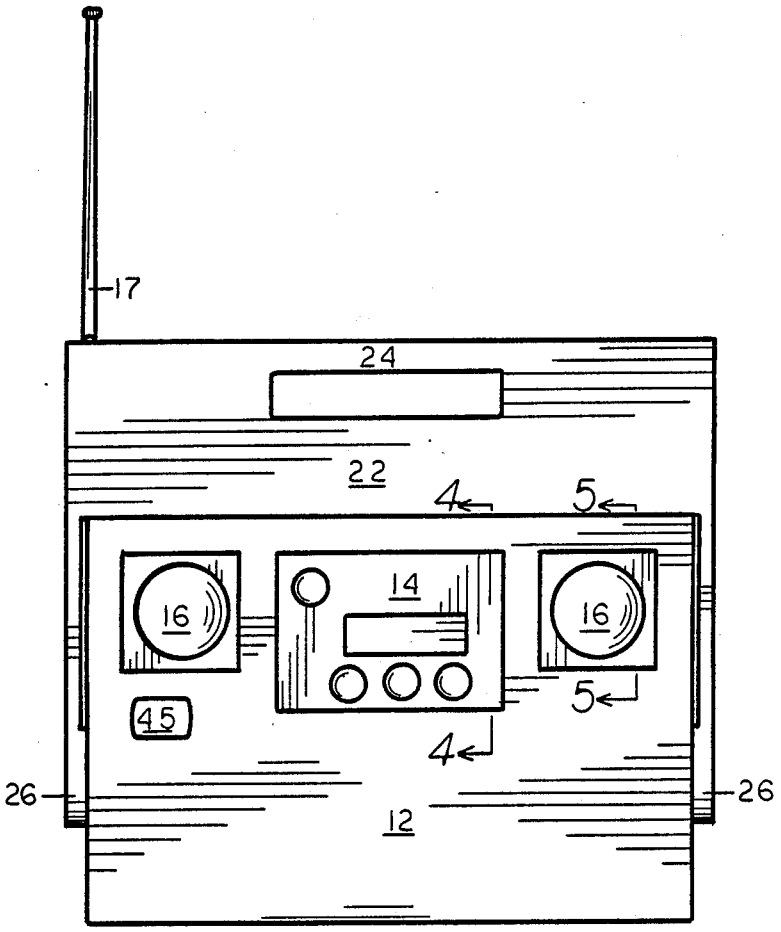
FIG. 3 is a front elevational view of the improved cooler of the invention with a radio receiver.

As connected to the socket 27, and as shown in FIGS. 1 and 3, the antenna 19 which normally rests in a groove provided in the handle 24 disposed in parallel relationship therewith and intermediately adjacent thereto, being movably mounted at one end in socket 27, may be raised to an upright position in perpendicular relationship with the handle for receiving transmitted radio signals. Antenna cable 19 is connected to socket 27 and extends downwardly along one side of the handle 24 and continues along one side of the top 22 to the hinge means 26 thence running to the receiver 14.

Figure 4:
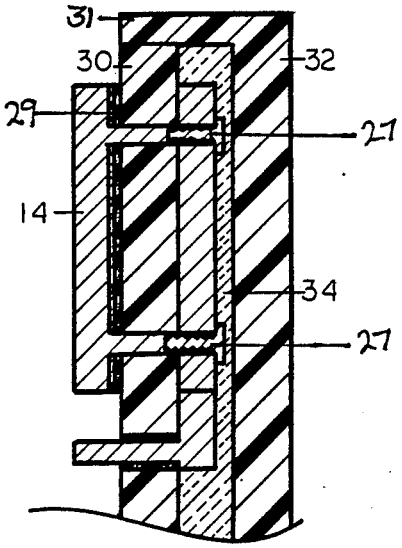
FIG. 4 is a sectional view along lines 4—4 of FIG. 3 showing the radio receiver mounted in the wall of the cooler.
Figure 5:
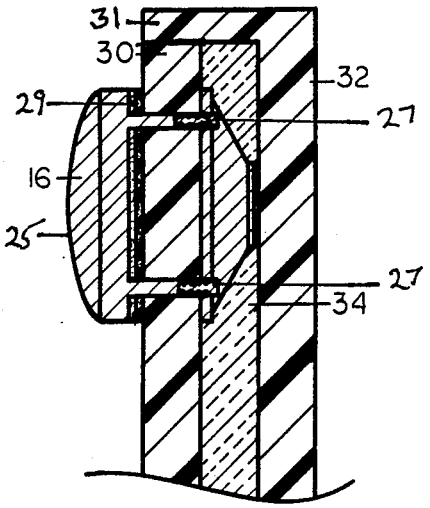
FIG. 5 is a sectional view along lines 5—5 of FIG. 3 showing a speaker mounted in the wall of the cooler.

As shown in FIG. 2, cooler 12 includes an insulated container 28 of generally rectangular shape and of sandwich construction having an outer shell 30 of generally rectangular construction constructed of a sheet of resilient molded plastic an inner shell 32 also of generally rectangular construction constructed of a sheet of resilient molded plastic spaced inwardly of and connected to outer shell 30 by lip member 31 thereby creating an intermediate void 33 as shown in FIGS. 4 and 5. As shown in FIG. 2, cooler 12 includes an insulated container 28, an intermediate layer of foam insulation 34 disposed between the inner shell 32 and the outer shell 30, four adjoining walls, including a first wall 36 and a second wall 38 integrally connected to a base 41 defining a space for storing items being kept cool. The insulation 34 has a composition adapted to permit pumping of the insulating material into the void 33 to fill it and to sealably encase the radio circuit 13 components and wire means 20 during construction of the container 28.

As shown in FIGS. 1 and 2, the radio circuit 13 incorporated in the construction of the cooler 12 includes a radio receiver 14, securely positioned in the central portion of first wall 36, the first and second speakers 16, securely positioned on either side of the radio receiver 14 on the first wall 36, and the power source 18, preferably 9 volt dc current battery is clipped into battery compartment 44 provided adjacent to an intermediately below the first speaker in the first wall. Wire means 20, preferably being rubber coated for waterproof protection connect the radio components including the battery and are disposed in the void with foam insulation inserted to sealably enclose the wire means 20.

As shown in FIGS. 4 and 5, the radio circuit members including the radio receiver 14, the speakers 16 and the battery 18 are securely mounted in the first wall-by screw means extending from mounting plate means disposed in void with the screw means extending outwardly through a plurality of cut-outs provided in the outer shell 30. The receiver 14 is securely attached to the outer shell 30 portion of the first wall by screw means 27 with gasket means 29 being provided to keep out moisture. The speakers 16 are provided with screen means 25 and gasket means 29 to keep out contamination such as sand and water.

Figure 6:
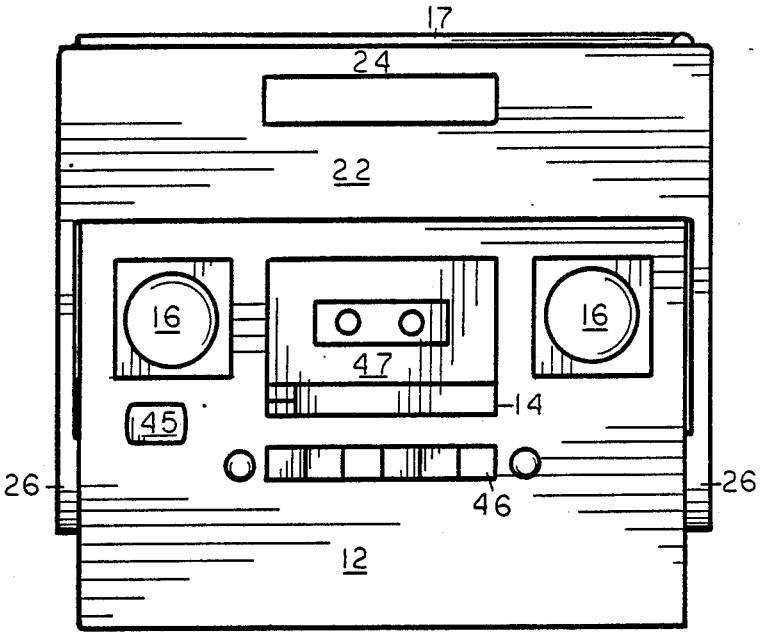
FIG. 6 is a front elevational view of an embodiment of the improved combination cooler and audio system with a tape cassette.

As illustrated more particularly in FIG. 6, another embodiment of the invention includes an audio unit comprised of a cassette 47 for playing tapes, mounted on the first wall with cassette controls 46 provided adjacently below.

Figure 7:
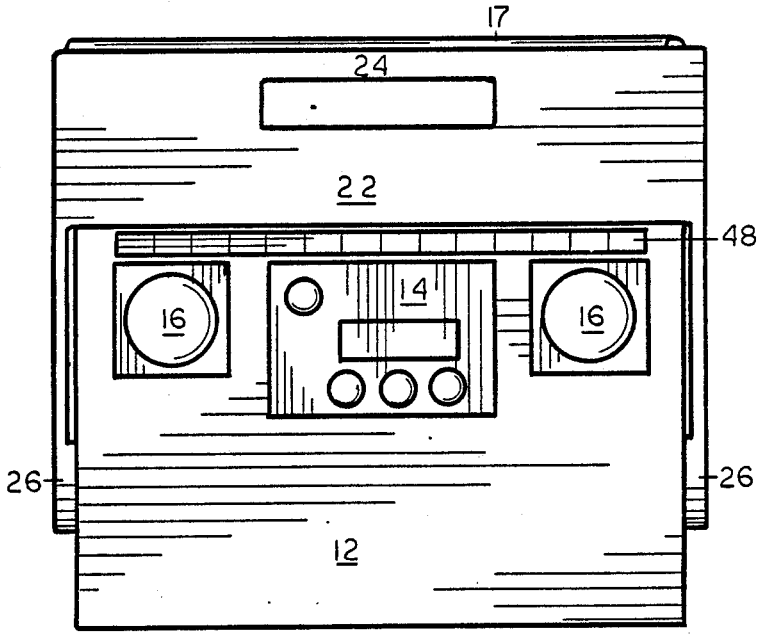
FIG. 7 is a front elevational view of the improved combination cooler with radio and solar power cell.

As illustrated more particularly in FIG. 7, another embodiment of the invention includes a solar power unit 48 mounted on the first wall 36.

What is claimed is:

1. A portable cooler for carrying food and/or beverages comprising:

(A) an insulated container of generally rectangular conventional construction including a coolant packet comprising;

i. an outer shell of generally rectangular construction constructed of a sheet of molded plastic;

ii. an inner shell spaced inwardly and connected to the outer shell forming an intermediate void;

iii. an intermediate layer of insulating material having a composition adapted to permit pouring of the insulating material into the void to fill it during construction of the container;

(B) four adjoining walls, including a first wall and a second wall integrally connected to a base defining a space for storing and carrying items, being kept cool;

(C) an audio unit having an electrical circuit securely mounted in the first wall comprising;

i. a receiver securely attached to the first wall and extending into the void between the outer shell and the inner shell with conventional control knob means extending outwardly through a cut-out in the outer shell and being sealably surrounded by the insulating material;

ii. a speaker member securely mounted on the first wall having mounting plate means positioned in the void between the outer shell and the inner shell with screw means extending outwardly through a cut-out in the outer shell and being sealably surrounded by the insulating material;

iii. a power source compartment formed in the void between the outer shell and the inner shell with an opening in the outer shell and being sealably surrounded by the insulating material;

(D) An antenna retractably mounted on the longitudinal handle having a first position in a slot provided in the handle and a second position in perpendicular relation to the handle for receiving transmission signals;

(E) a partially removable top, having hinged cooperation with the container, (F) a plurality of wire means for connecting the power source compartment to the radio receiver and to the first and second speakers being disposed in the void and sealably surrounded by insulating material.

2. The improved portable cooler of claim 1 wherein the receiver, the first and second speakers and the power source compartment are sealably positioned and affixed in the wall by liquid foam insulation inserted between the outer shell and the inner shell.

3. The improved portable cooler of claim 1 wherein the top is hinged for opening and is provided with an integral handle and latching means.

4. The improved portable cooler of claim 1 wherein the power source is a 9 volt d.c. battery.

5. The portable cooler of claim 1 wherein the audio unit comprises a plurality of speakers.

6. The portable cooler of claim 1 wherein the audio unit comprises an AM/FM radio.

7. The improved portable cooler of claim 1 wherein the audio unit is a compact disc player.

8. The improved portable cooler of claim 1 wherein the power source is a solar power unit.

9. an improved cooler with audio receiver system, for carrying food and beverages with coolant pack comprising;

(A) an insulated container of generally rectangular construction comprising;

i. an outer shell constructed of hard plastic of a generally rectangular construction having a plurality of cut-outs comprising an audio receiver cut-out, one or more speaker cut-outs and a power source compartment;

ii. an inner shell connected to and concentric with the outer shell providing an intermediate void;

iii. an intermediate layer of insulating material filling the void and surrounding the compartments;

iv. four adjoining walls integrally connected to a base defining a space for items where a first wall includes a receiver compartment in cooperation with the audio receiver cut-out and one or more speaker compartments in cooperation with the speaker cut-out, and a power source compartment in cooperation with the power source cut-out wherein the insulating material encloses the compartments, (B) an audio unit having an electrical circuit securely mounted in the first wall comprising:

i. a receiver securely attached to the first wall extending into the void between the outer shell and the inner shell with conventional control knob means extending outwardly through a cut-out in the outer shell and being sealably surrounded by the insulating material;

ii. a speaker member securely mounted on the first wall having mounting plate means positioned in the void between the outer shell and the inner shell with screw means extending outwardly through a cut-out in the outer shell and being sealably surrounded by the insulating material;

iii a power source compartment formed in the void between the outer shell and the inner shell with an opening in the outer shell and being sealably surrounded by the insulating material;

(C) electrical means for connecting the audio circuit components including the audio receiver component is installed in a compartment provided in first wall, the speaker component is installed in the speaker compartment.

(D) wire means connecting the audio receiver, the speaker member and the power source.

* * * * *